United States Patent [19]

Horvath

[11] 3,952,929

[45] Apr. 27, 1976

[54] CLOTHES HANGER AND METHOD FOR THE MANUFACTURE THEREOF

[75] Inventor: Tibor Horvath, Brooklyn, N.Y.

[73] Assignee: Abraham Douek, Brooklyn, N.Y. ; a part interest

[22] Filed: July 17, 1974

[21] Appl. No.: 489,075

[52] U.S. Cl. ..... 223/94; 223/95; 140/91

[51] Int. Cl.[2] ..... A47J 51/11

[58] Field of Search ..... 223/89, 95, 94, 88; 211/119, 113; 140/91

[56] References Cited

UNITED STATES PATENTS

| | | | |
|---|---|---|---|
| 773,583 | 11/1904 | Nagely | 223/95 |
| 823,376 | 6/1906 | Twitchell | 223/95 |
| 1,769,076 | 7/1930 | Shrack | 223/94 |
| 2,145,503 | 1/1939 | Anderson | 223/95 |
| 2,393,263 | 1/1946 | Puzio | 223/95 |
| 2,594,602 | 4/1952 | Walter | 223/95 |
| 2,621,834 | 12/1952 | Irving | 223/89 |
| 2,644,621 | 7/1953 | Urban | 223/95 |
| 2,775,379 | 12/1956 | Gordon | 223/95 |

FOREIGN PATENTS OR APPLICATIONS

| | | | |
|---|---|---|---|
| 447,232 | 5/1936 | United Kingdom | 223/95 |

*Primary Examiner*—George H. Krizmanich
*Attorney, Agent, or Firm*—Peter L. Tailer

[57] ABSTRACT

A clothes hanger has a hook, legs extending downward from the hook, and laterally extending garment engaging arms, at least the hook and the legs preferrably being bent from a single length of spring wire. Each arm is urged outward by one of the legs which has its lower end connected or integrally formed with the inner end of the arm, and each arm is slidable supported by the lower end of the other leg. In all embodiments of this invention, the arms are connected to the legs to be resiliently urged outwards thereby so that the outer ends of the arms may engage the inside of the waistband of a garment to support it. Some embodiments of this invention are fabricated from a single length of spring wire bent and formed according to a given process, the center of the wire being bent double to form the hook with the remainder of the wire forming the legs, the arms, and even additional telescoping garment support bars.

5 Claims, 11 Drawing Figures

CLOTHES HANGER AND METHOD FOR THE MANUFACTURE THEREOF

BACKGROUND OF THE INVENTION

Clothes hangers having outwardly springing arms to engage the waistbands of garments such as skirts or slacks are costly and require assembly. This invention provides a less costly and superior hanger of this type.

SUMMARY OF THE INVENTION

A clothes hanger has a spring wire hook or ring to engage a rack rod and it has two legs extending downward therefrom. In a preferred embodiment, the hanger is formed from a single length of spring wire with the hook and the legs bent from the center of the wire and the ends of the wire forming garment supporting arms, the arms being urged outward to engage the waistband of a garment by the spring of the legs. The lower end of each leg is bent into a hook or loop in which the arm extending from the other leg is slidably supported. The outer ends of the arms have upward extending ends bent into ripples or corrugations to hold the waistband of a garment. In the preferred embodiment of the invention, the ends of the arms are further extended inward as curved horizontal bars terminating in hooks, each bar sliding in the hook of the other so that the bars telescope and provide a surface over which a jacket can be hung. The process of this invention bends a hanger from a single length of spring wire for quick and easy assembly with a minimum of hand labor involved. This provides a very inexpensive hanger at a low relative cost. The hanger of this invention is particularly suited to factory and showroom use, although it is not so limited.

DESCRIPTION OF THE PREFERRED EMBODIMENTS

Figure 1:
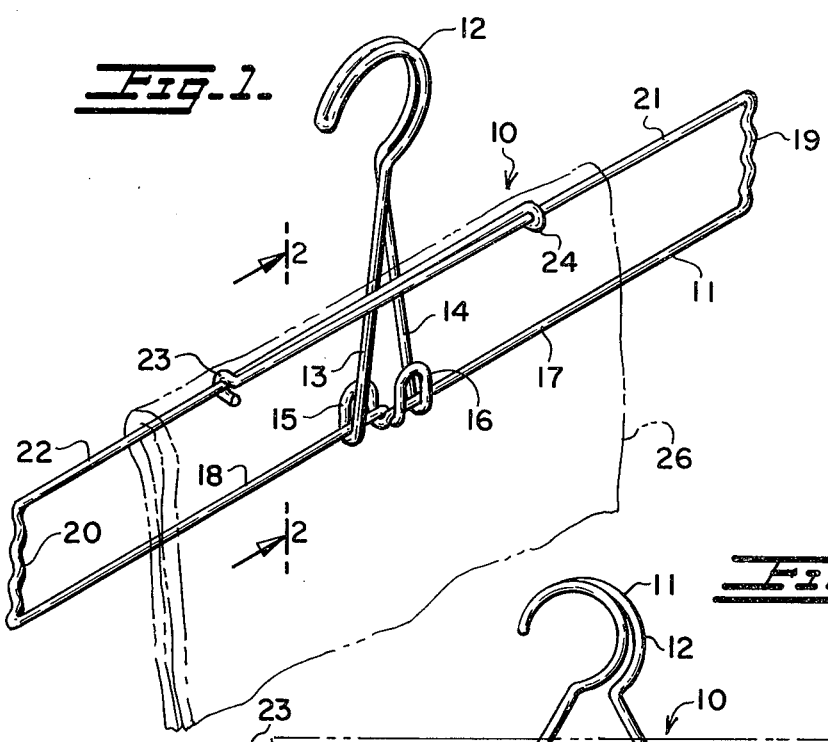
FIG. 1 is a perspective view of a hanger according to a second embodiment of this invention with a pair of slacks shown in phantom lines handing on bars thereof.
Figure 2:
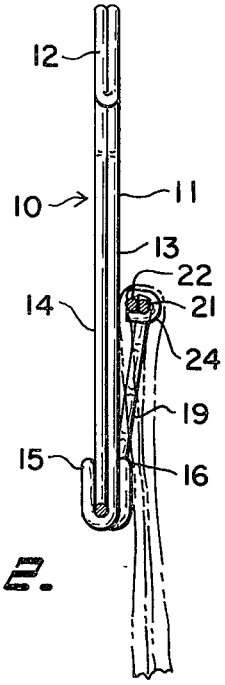
FIG. 2 is a section taken on line 2—2 of FIG. 1.
Figure 3:
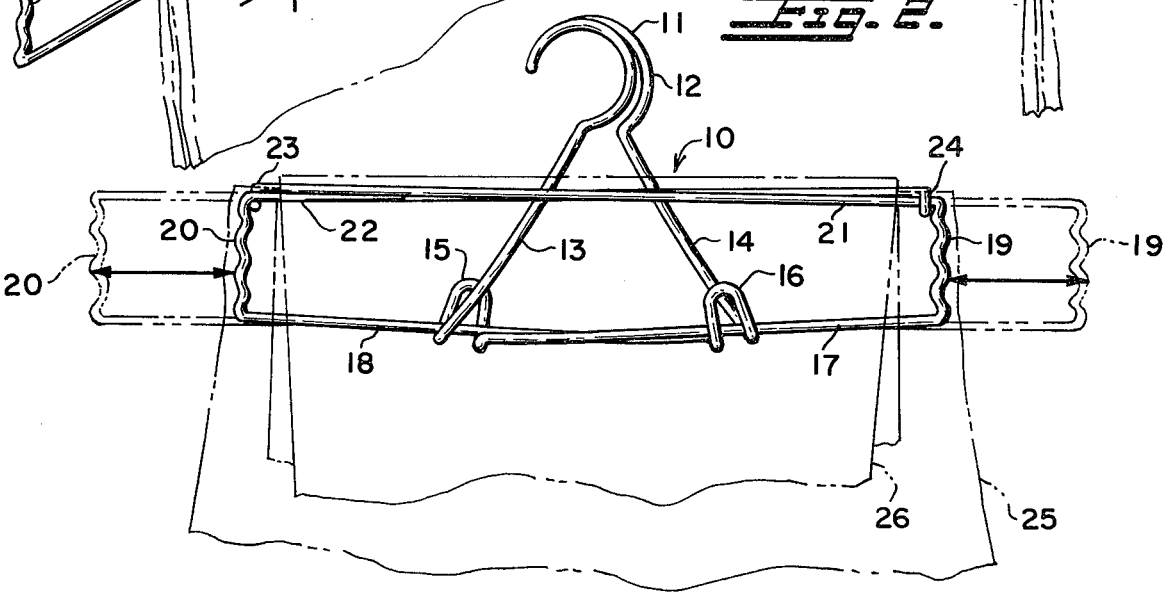
FIG. 3 is a side view of the hanger of FIG. 1 shown compressed from an extended position shown in phantom lines to hold a skirt by its waistband.

As shown in FIGS. 1, 2, and 3, a second embodiment of this invention is a hanger 10 formed from a single length of suitable spring wire 11. Hanger 10 has a hook 12 bent to have two legs 13 and 14 extend downward therefrom. At the bottom of each leg 13 and 14, there is formed an upward and inward facing guide loop 15 and 16 from which horizontal arms 17 and 18 extend, arm 17 slidably resting in guide loop 16 and arm 18 slidably resting in guide loop 15. The ends of the arms 17 and 18 extend upward and form the corrugations 19 and 20 and they then bend inwards to form the upper bars 21 and 22 terminating in the hooks 23 and 24 so that hook 24 slidably secures bar 21 and hook 23 slidably secures bar 22. This enables bars 21 and 22 to telescope when the outer ends of the arms 17 and 18 are compressed against spring tension of the legs 13 and 14.

This second embodiment of the invention is used by compressing the ends 19 and 20 to insert them in the waistband of a garment such as a skirt 25 shown in FIG. 3. The springing of the hook 12 and legs 13 and 14 urges the ends 19 and 20 outward so that their corrugations hold a garment 25 securely. A pair of slacks 26 may be hung on the telescoping bars 21 and 22 which are disposed on one side of the legs 13 and 14.

Figure 4:
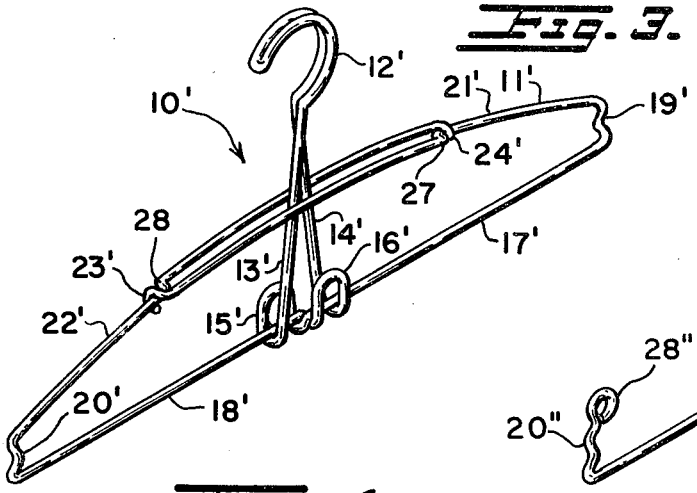
FIG. 4 is a perspective view of a first and preferred embodiment of the hanger of this invention, the hanger having curved, telescoping jacket supporting bars.

FIG. 4 shows a first and preferred embodiment of this invention. A hanger 10′ of one piece of spring wire 11′ has a hook 12′ with legs 13′ and 14′ depending therefrom. The legs 13′ and 14′ have their lower ends formed into guide loops 15′ and 16′ and then the arms 17′ and 18′. Guide loop 15′ slidably receives arm 18′ and guide loop 16′ slidably receives arm 17′. The arms 17′ and 18′ have their outer ends formed into the corrugated ends 19′ and 20′ from which the curved bars 21′ and 22′ extend inwardly to terminate in the hooks 23′ and 24′. Hook 23′ slidably receives bar 22′ and hook 24′ slidably receives the bar 22′. The hooks 23′ and 24′ thus telescopically join the bars 21′ and 22′.

The first preferred embodiment of this invention has its ends 19′ and 20′ compressed and inserted in the waistband of a garment to hang a pair of slacks or a skirt and it can have a jacket or coat hung on the curved bars 21′ and 22′. The bars 21′ and 22′ are offset, respectively, at 27 and 28 to allow the bars 21′ and 22′ to span or pass on both sides of the legs 13′ and 14′ for greater stability of structure. Offsets 27 and 28 co-act with hooks 23′ and 24′ and join with the guide loops 15′ and 16′ to limit the outward extension of the arm ends 19′ and 20′.

Figure 6:
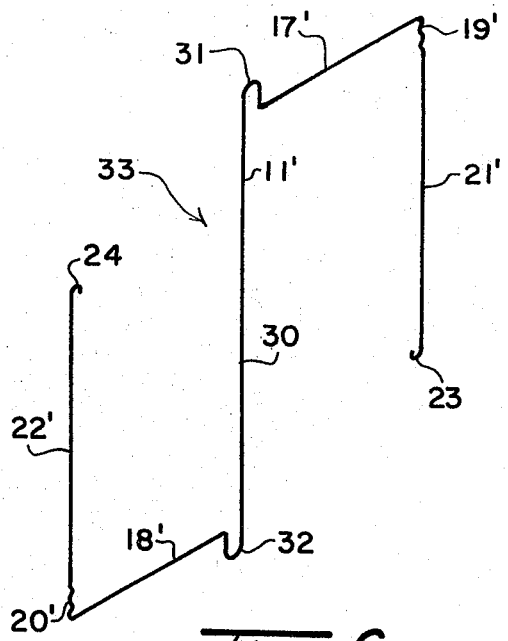
Figure 7:
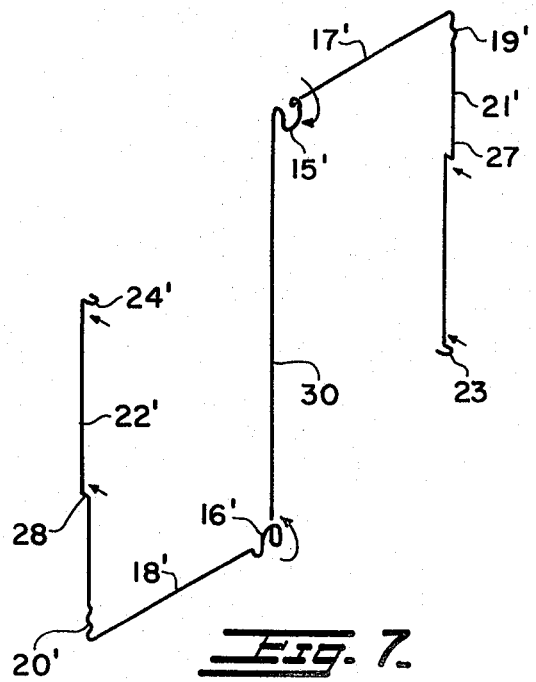

Referring now to FIGS. 6–11, the first and preferred embodiment of this invention is made in the following manner by a specific process. Spring wire 11′ is bent into a form 33 as shown in FIG. 6. Form 33 is formed in one plane to have a straight center run 30, 180° open loops 31 and 32, arms 17′ and 18′, corrugations 19′ and 20′, bars 21′ and 22′, and hooks 23′ and 24′. As shown in FIG. 7, the form 33 is bent in a vertical plane so that the loops 31 and 32 form the guide loops 15′ and 16′, the offsets 27 and 28 are formed, and the hooks 23′ and 24′ are bent to extend upward in the same direction as the guide loops 15′ and 16′.

Figure 8:
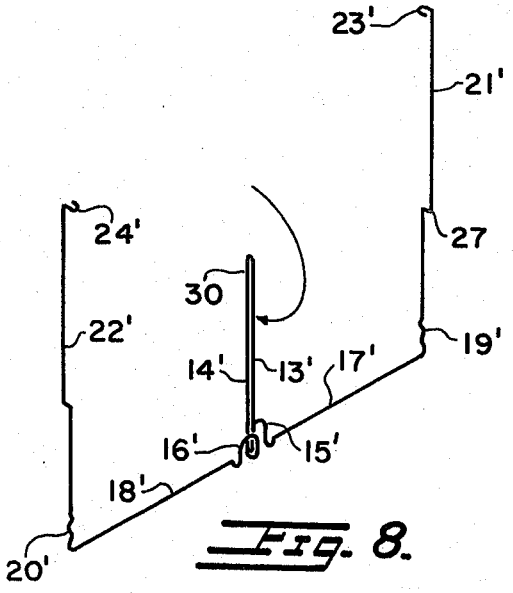
Figure 9:
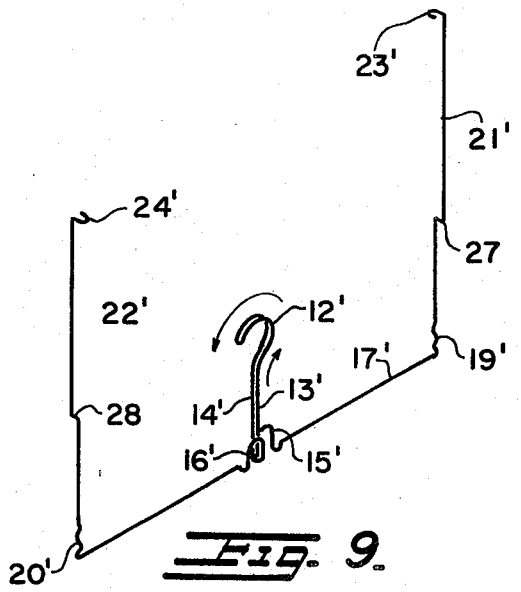
Figure 10:
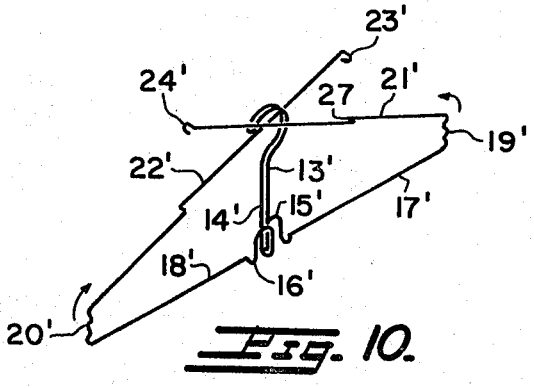
Figure 11:
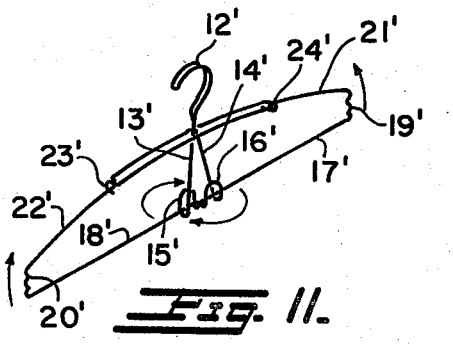

As shown in FIG. 8, the center run 30 is bent 180° upwards in its center to form the legs 13′ and 14′ and place the guide loops 15′ and 16′ adjacent to each other. As shown in FIG. 9, the legs 13′ and 14′ are bent to form hook 12′. As shown in FIG. 10, the bars 21′ and 22′ are bent inwards to extend on both sides of the legs 13′ and 14′, the bends being made above the corrugated ends 19′ and 20′. FIG. 11 shows the final assembly of hanger 10′ as the arms 17′ and 18′ are pushed inward and flexed upward to rest arm 17′ in guide loop 16′ and arm 18′ in guide loop 15′. The hooks 23′ and 24′ receive the bars 22′ and 21′, respectively. The offsets 27 and 28 allow the bars 21′ and 22′ to extend on each side of the legs 13′ and 14′. On completing this assembly, the legs 13′ and 14′ are flexed slightly to urge the ends 19′ and 20′ against their maximum extension which is limited by the stop action of the guide loops 15′ and 16′ and the hooks 23′ and 24′ contacting the offsets 27 and 28. Since assembly has the legs 13′ and 14′ force the ends 19′ and 20′ outward to their maximum limit, hanger 10' will hold a garment with a waistband only slightly smaller than the full extension of the ends 19' and 20'. It will also hold garments that can be placed over its ends 19' and 20' at their maximum compression. This first and preferred embodiment of this invention can be used in factories, showrooms, and in homes. It is inexpensively and substantially fully automatically made according to the above described process.

Figure 5:
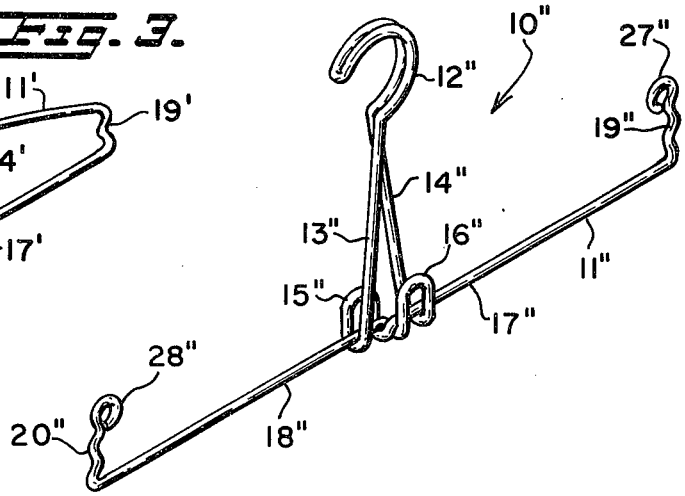
FIG. 5 is a perspective view of a hanger according to a third embodiment of this invention; and, FIGS. 6, 7, 8, 9, 10, and 11 are perspective views of a length of wire being progressively bent and assembled into the hanger of FIG. 4.

As shown in FIG. 5, a hanger 10'' comprises the third embodiment of this invention. Hanger 10'' is formed from a single length of spring wire 11'' bent to have a hook 12'', legs 13'' and 14'', guide loops 15'' and 16'', arms 17'' and 18'', and corrugated ends 19'' and 20''. The ends 19'' and 20'' terminate in the closed loops 27'' and 28'' to prevent the ends 19'' and 20'' from catching on and tearing a garment supported by its waistband by the outwardly urged ends 19'' and 20''. The hanger 10'' of FIG. 5 is particularly suitable for use in garment factories to hold completed skirts and slacks on racks for storage and transportation. It may also be used in sales rooms. It is far easier to use than the present factory practice of pinning garments to conventional hangers. Hanger 10'' is far less costly than existing factory and show room hangers which have compression springs to urge garment holding ends outward from a central frame in which they are slidably mounted.

While this invention has been shown and described in the best forms known, it will nevertheless be understood that these are purely exemplary and that modifications can be made without departing from the spirit of the invention. For example, the ends of hanger arms can be dipped in a high friction rubber material to hold garment waistbands. Other material than spring wire of circular cross section could be used.

What is claimed is:

1. A hanger of a single length of wire formed to expand and grip the waistband of a garment comprising, in combination, a 180° bend in the center of said length of wire forming parallel lengths of wire adjacent to said 180° bend, a hook to secure said hanger to a rack pole formed from said parallel lengths of wire adjacent to said 180° bend, two legs of said wire having lower ends extending downward from said hook and diverging from each other, an upward and inward facing guide loop at the lower end of each of said legs, arms of said wire extending horizontally from said guide loops, each of said arms being slidably supported by the guide loop from which the other of said arms extends, outer ends of said arms being bent upwards to engage the waistband of a garment, said guide loops contacting each other to serve as stops limiting the outward extension of said outer ends of said arms, bars of said wire extending inwards from said upward bent outer ends of said arms, and bar securing hooks at the ends of said bars, said bars overlapping each other, said bar securing hooks of each bar slidably engaging the other of said bars, said bars telescoping as said ends of said bars are compressed, compression of said outer ends of said arms flexing said legs so that said legs urge said arms outward to engage the outer ends of said arms with the waistband of a garment to support it.

2. The combination according to claim 1 with the addition of offsets (23' and 24') in said bars (21' and 22'), said hooks of each of said bars slidably engaging the other of said bars between said offset of said bar and said outer end of said integral arm, said bars extending on both sides of said legs and being curved to hang a jacket thereon.

3. The process of forming a clothes hanger which expands to secure the waistband of a garment from a single length of wire comprising the steps of:

a. bending a length of wire in one plane into a form having a single center run, U-shaped outwardly extending loops at the ends of the center run, arms extending from the loops at 90° to the center run, and garment engaging corrugations at right angles to the ends of the arms, b. bending the loops upward and inward to form guide loops, c. making a 180° bend in the center of the center run to form two parallel legs with the guide loops disposed on opposite sides thereof, d. bending a garment rack pole engaging hook from the top of the parallel legs, and e. assembling the hanger for use by forcing the arms inward placing each arm slidably in a guide loop.

4. The process according to claim 3 wherein; in step (a), the length of wire is further bent to have bars extend parallel to the center run inwardly from the ends of the corrugations and to have hooks formed at the ends of the bars; in step (b), the hooks are bent upward at 90°; and, in step (e) the hooks of one bar are slidably engaged with the other bar.

5. The process according to claim 4 wherein; in step (b), downward extending offsets are formed in the bars, and, in step (e) the hook of each bar engages the other bar with the bars extending on both sides of the legs.

* * * * *